US005957074A

United States Patent [19]

de Baan et al.

[11] Patent Number: 5,957,074

[45] Date of Patent: Sep. 28, 1999

[54] MOORING AND RISER SYSTEM FOR USE WITH TURRENT MOORED HYDROCARBON PRODUCTION VESSELS

[75] Inventors: Jaap de Baan, Maassluis; Ries Uittenbogaard, Kamerik, both of Netherlands

[73] Assignee: Bluewater Terminals B.V., Hooffddorp, Netherlands

[21] Appl. No.: 08/843,415

[22] Filed: Apr. 15, 1997

[51] Int. Cl.[6] ..... B63B 21/50

[52] U.S. Cl. ..... 114/230; 114/293

[58] Field of Search ..... 114/293, 230; 405/195.1; 166/354

[56] References Cited

U.S. PATENT DOCUMENTS

| | | | |
|---|---|---|---|
| 4,753,185 | 6/1988 | Salusbury-hughes | 114/230 |
| 5,222,453 | 6/1993 | Chabot | 114/230 |
| 5,639,187 | 6/1997 | Hartley et al. | 405/195.1 |

FOREIGN PATENT DOCUMENTS 2 286 166 8/1995 United Kingdom .

OTHER PUBLICATIONS

Alexander, et al, "A Hybrid Riser for Deep Water," Offshore South East Asia 10th Conference, Paper No. OSEA–94113, Dec. 6–9, 1994, pp. 1–8.

*Primary Examiner*—Sherman Basinger
*Attorney, Agent, or Firm*—Jenkens & Gilchrist PC

[57] ABSTRACT

A mooring and riser system for use with hydrocarbon production vessels includes a turret mooring system in which the mooring lines are grouped such as to have open sectors therebetween. Included in the open sector is a riser system which includes a subsea buoyancy element. Steel catenary production risers from the wellheads on the sea floor rise to the subsea buoyancy element. At the subsea buoyancy element, the steel catenary production risers are connected to flexible tubular jumper members which are then connected to the turret of the hydrocarbon production vessel.

24 Claims, 6 Drawing Sheets

MOORING AND RISER SYSTEM FOR USE WITH TURRENT MOORED HYDROCARBON PRODUCTION VESSELS

FIELD

The present invention relates to mooring and riser systems used in the offshore production of hydrocarbons; more particularly, the present invention relates to a mooring and riser system for use with a turret moored hydrocarbon production vessel.

BACKGROUND

In recent years, one method of producing hydrocarbons from subsea wells has involved the use of a turret moored hydrocarbon production vessel. The turret is typically placed within or adjacent to a surface vessel which receives hydrocarbons through production risers connected to wells on the sea floor. Mooring lines are used to hold the hydrocarbon production vessel in place.

The turret allows the hydrocarbon production vessel to weather vane in response to environmental forces, while continuing to receive hydrocarbon fluids from subsea wells.

In very deep water, it is impractical to connect production risers from the wells on the sea floor directly to the turret of the hydrocarbon production vessel due to the weight of the production risers. Additionally, in harsh environments, the hydrocarbon production vessel located at the sea surface may experience large horizontal and vertical motions due to the environmental forces of wind and waves. These large horizontal and vertical motions of the turret of the hydrocarbon production vessel can result in large unacceptable bending, tension and compression fluctuations and excessive fatigue loadings in the production risers. Such bending, tension and compression fluctuations may eventually damage the production risers or in the worst case render the production risers completely unusable.

There is, therefore, a need in the art to both provide a system which can both be used in deep water with hydrocarbon production vessels and which will also decouple the effects of the large horizontal and vertical motions of the turret of such a hydrocarbon production vessel from the production riser system. Such system should not interfere with the mooring lines connected to the turret of such a hydrocarbon production vessel to hold the vessel in place.

SUMMARY

The mooring and riser system for use with hydrocarbon production vessels of the present invention is both usable in deep water with production risers extending from the sea floor and it also decouples the effects of the large horizontal and vertical motions of the turret of such a hydrocarbon production vessel from the production riser system.

The present invention includes a mooring system where the individual mooring lines are grouped around the turret. The placement of the individual mooring lines in groups around the turret allows open sectors to be formed between the groups of mooring lines. Placed in these open sectors is the riser system. The present invention relates to the combination of the riser system with the grouped pattern of the mooring lines.

The riser system included in the present invention includes a long, slender, subsea buoyancy element which is affixed to the sea floor and positioned below the wave zone. Steel catenary production risers extend from the wellheads on the sea floor to the subsea buoyancy element. At the subsea buoyancy element, the steel catenary production risers are connected to flexible tubular jumper members which extend from the subsea buoyancy element to the turret of the hydrocarbon production vessel.

BRIEF DESCRIPTION OF THE FIGURES

A better understanding of the present invention may be had by reference to the drawing figures wherein.

DESCRIPTION OF THE EMBODIMENTS

General Description

Figure 1:
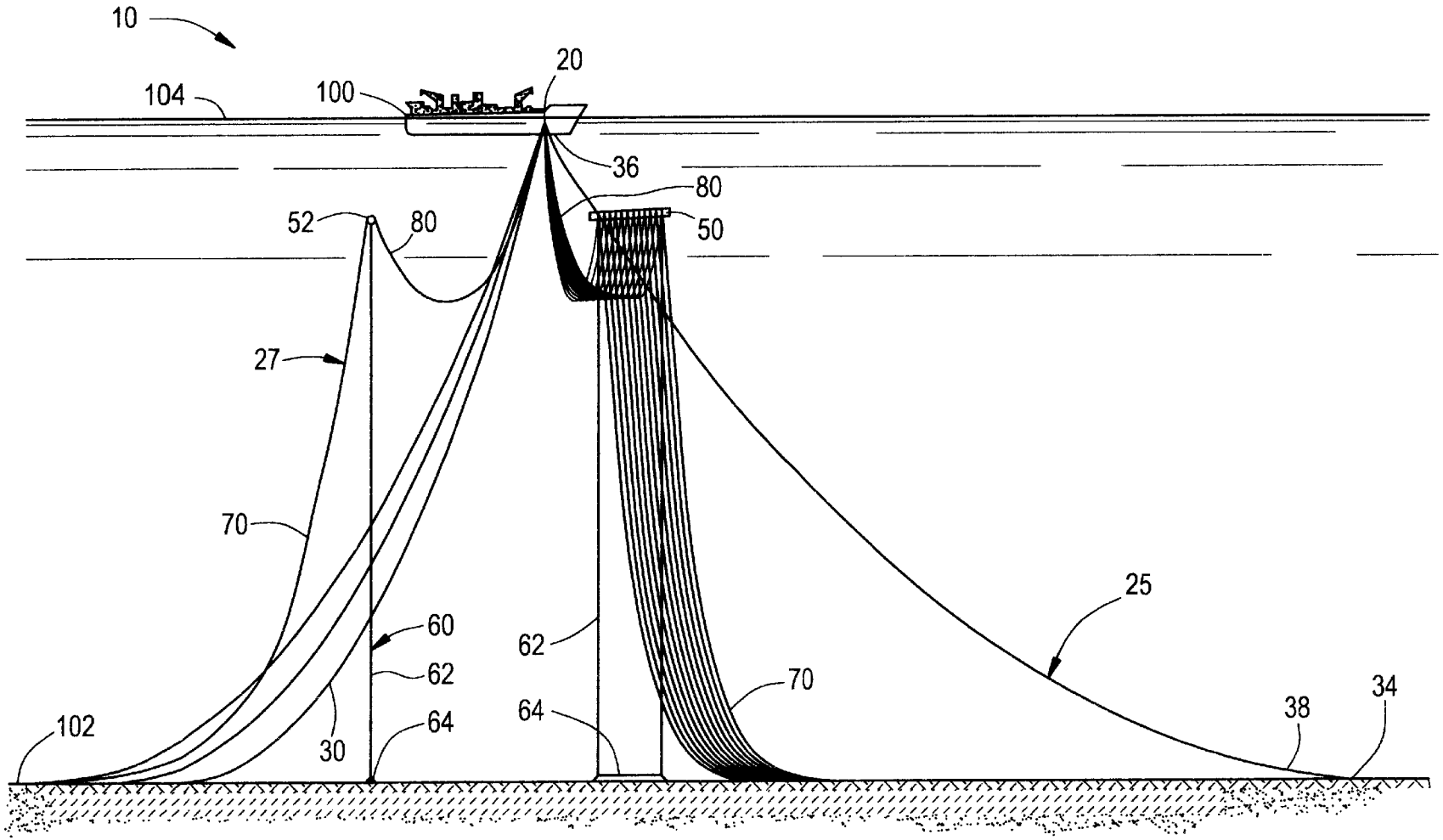
FIG. 1 is an elevational view of the mooring and riser system for use with turret moored hydrocarbon production vessel of the present invention.

As shown generally in FIG. 1, the present invention relates to a mooring and riser system 10 for use with hydrocarbon production turrets 20 in deep water. Typically such mooring and riser systems 10 are used with vessels 100 which are allowed to weather-vane or rotate around the hydrocarbon production turret 20 in response to current, wind and wave conditions at the sea surface 104. The vessel 100 may be fixed at a permanent location on the sea surface 104 or it may be a disconnectable, moored ship shape floating body which is capable of rotating a full 360° or more about a hydrocarbon production turret 20.

The mooring system 25 used with the vessel 100 or a hydrocarbon production turret 20 includes a bundled or grouped mooring line configuration. In the preferred embodiment, the groups of mooring lines 31, 32, 33 are spaced 120° apart from each other around the hydrocarbon production turret 20. Individual mooring lines 30 are attached on a first end 36 to the hydrocarbon production turret 20 and affixed 34 on a second end 38 to the seafloor 102. Such affixing 34 of each individual mooring line 30 to the sea floor 102 may be accomplished by using a driven pile, a drilled and grouted pile, a suction pile, a drag embedment anchor or a gravity weight. Such means of attachment are well known to those of ordinary skill in the art.

The riser system 27 includes at least one long, slender, circular subsea buoyancy element 50 which is affixed to the sea floor 102 by a system 60 which includes tethers 62. The subsea buoyancy element 50 is horizontally positioned below the wave zone under the sea surface 104 such that a vertical plane perpendicular to the longitudinal axis 51 of the buoyancy element 50, taken at its mid-point, coincides with a vertical plane through the hydrocarbon production turret 20, which vertical plane bisects the 120° sector between the adjacent groups of individual mooring lines 30. Although the above described position of the subsea buoyancy element 50 is most logical, other positions within the 120° sector may be possible.

The structure which affixes the buoyancy element 50 to the sea floor 102 may be a gravity base 64 which can be floated to its desired location and lowered to the sea floor 102 by controlled water ballasting. After final positioning on the sea floor 102, the gravity base 64 may be entirely filled with water or any other ballast medium. This gives the gravity base 64 sufficient weight to keep the long, slender, circular buoyancy element 50 in the desired location during its full operational lifetime. Alternatively, the gravity base 64 may be affixed to the sea floor 102 by other conventional means, such as piles. Such other conventional means of affixing structures to the sea floor are well known to those of ordinary skill in the art.

Once installed, the subsea buoyancy element 50 provides a stable support for the steel catenary production risers 70 which are typically installed during favorable weather conditions prior to the arrival of the vessel or ship shaped floating body 100. This installation flexibility can provide large cost savings as the steel catenary production risers 70 are installed as a continuation of the installation of sea bed pipelines (not shown) extending from the wellheads.

Upon arrival of the vessel or ship shaped floating body 100 to the predetermined site and after hook-up to the groups 31, 32, 33 of individual mooring lines 30, only the connection of the flexible tubular jumper members 80 to the steel catenary risers 70 is required.

Each open sector 41, 42, 43 between the groups of individual mooring lines 30 allows ample space to install one riser system and allow as such the tie in of additional steel catenary production risers 70 for the future production of hydrocarbons from or phased development of other wells on the sea floor 102.

Each group of mooring lines 31, 32, 33 preferably includes three lines. These groups 31, 32, 33 of individual mooring lines 30 connect to the hydrocarbon production turret 20 at their first end 36. Each individual mooring line 30 is affixed to the sea floor 102 at its second end 38.

Each individual mooring line 30 may have either a catenary or taut leg configuration and may be made of chain, steel-wire rope or synthetic fiber rope, or a combination of these materials. Also subsea mooring line buoys or clump weights may be a part of the mooring line system 25.

The location of the anchor points of the groups of individual mooring lines 30 allows the ship shaped floating body or vessel 100 to be located closer to the wells and as such minimizes the length of the fluid conduit lines laid on the sea floor 102.

The installation of the tethered buoyancy element 50 is done by towing the long slender subsea buoyancy element 50 and the gravity base structure to a location over which the gravity base structure 64 can be lowered to a position under the buoyancy element 50 by means of controlled water ballasting. Further ballasting will lower the gravity base structure 64 to the sea floor 102 and the subsea buoyancy element 50 to its final subsea level under the wave zone below the sea surface 104. Complete ballasting of the gravity base structure 64 will provide sufficient force to keep the long slender circular subsea buoyancy element 50 in position during its full operational life.

Specific Description

The ship shaped floating body or vessel 100 will naturally weather-vane around the hydrocarbon production turret structure 20 which is secured to the sea floor 102 by individual mooring lines 30. Hydrocarbons will be transported from the sea floor 102 to the vessel 100 or vice versa through conduit pipes 70 and 80. To avoid unacceptable tension and bending fluctuations and excessive fatigue loadings in the production risers 70, the steel catenary production risers 70 are suspended from the long horizontal circular subsea buoyancy element 50, which is affixed to the sea floor 102 by at least one tether 62. As shown in FIG. 1, a tether 62 is placed at each end 52 of the subsea buoyancy element 50. The tethers 62 are connected to the sea floor 102 by a gravity base structure 64. The flexible tubular jumper members 80 are made from flexible tubing which permits decoupling the motion of the floating body or vessel 100 from the steel catenary production risers 70 with the relatively fixed location of the buoyancy element 50.

The steel catenary production risers 70 require a certain separation distance to avoid banging into or abrading with each other in severe current and wave conditions. The length of the buoyancy element 50 is therefore determined by the number of steel catenary production risers 70 to be used and the required separation distance between individual steel catenary production risers 70.

Figure 2:
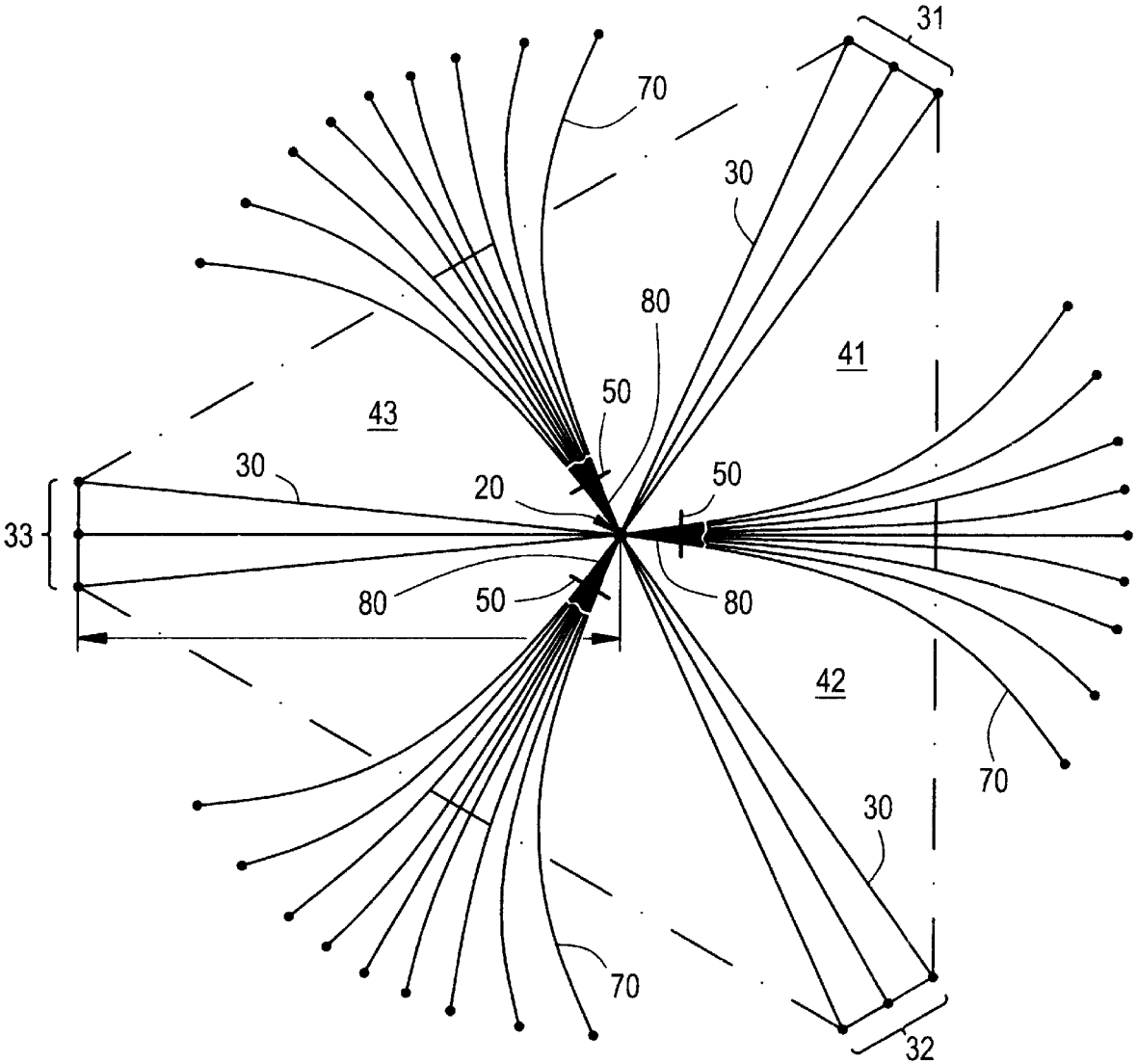
FIG. 2 is an overhead schematic view of the arrangement of the groups of mooring lines and the production risers.

As shown in FIG. 2, the long slender subsea riser buoyancy element 50 is positioned with its longitudinal axis 51 perpendicular to a vertical plane through the hydrocarbon production turret 20 and midway between adjacent mooring line bundles 31, 32, 33 in the open sectors 41, 42, 43 therebetween.

Figure 3:
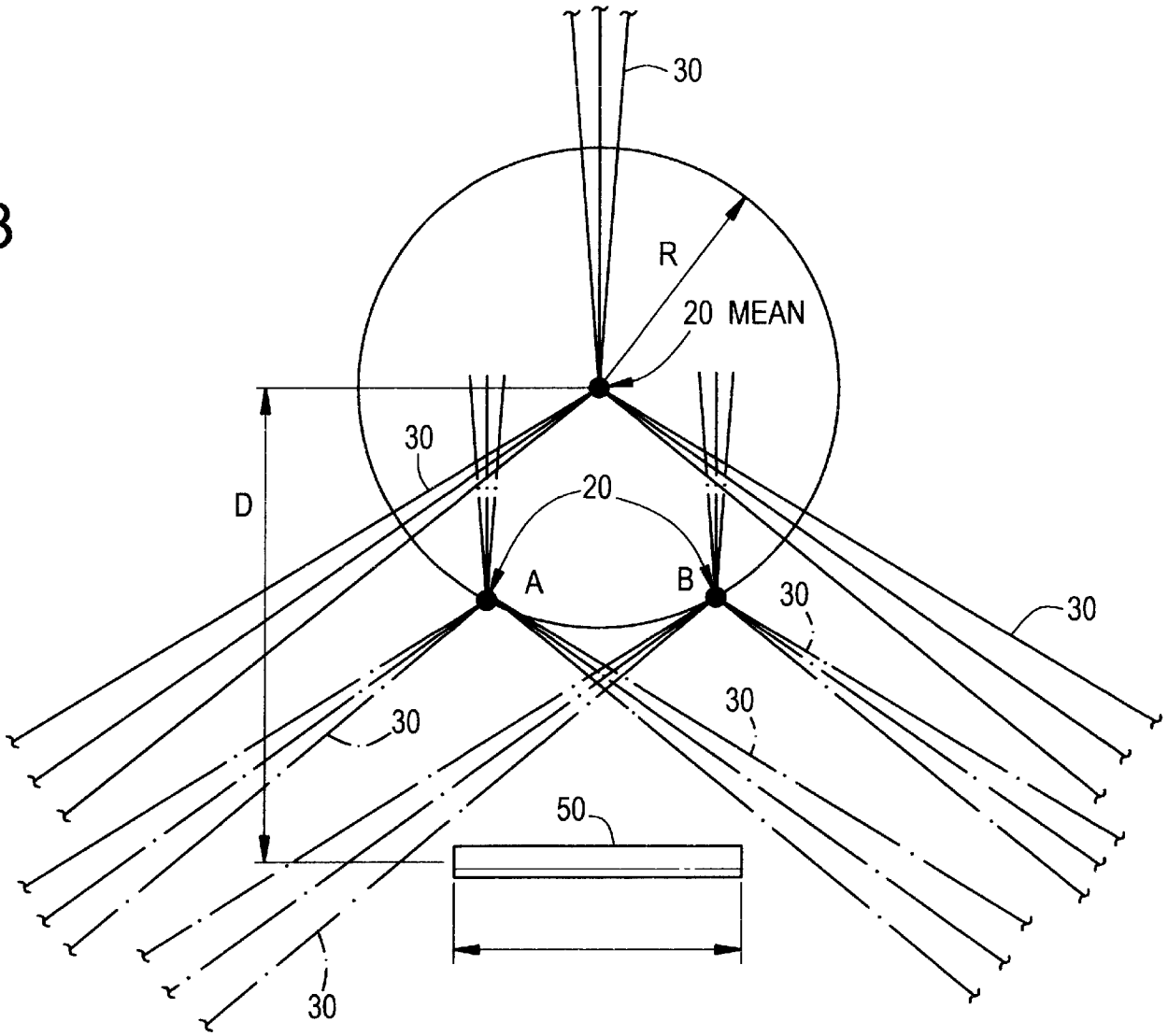
FIG. 3 is an overhead schematic view of the groups of mooring lines showing the possible movement of the groups of mooring lines associated with the displacement of the turret of the hydrocarbon production vessel due to the environmental forces of the wind and the waves at the sea surface and the current between the sea surface and the sea floor.

FIG. 3 shows the relative positions of the hydrocarbon production turret 20 with the mooring lines 30, and the long slender subsea riser buoyancy element 50. In mild environmental conditions, the hydrocarbon production turret 20 position is marked as MEAN in FIG. 3. In that case, the position of the buoyancy element 50 with respect to the MEAN location of the hydrocarbon production turret 20 is marked as distance D. In rougher environmental conditions, the forces of wind and waves on the floating body or vessel 100 will offset the position of the hydrocarbon production turret 20 to a distance marked R from its MEAN position. Since the forces of wind and waves can come from any direction, the envelope of possible positions for the hydrocarbon production turret 20 is approximated by a circle with a radius R. Because the buoyancy element 50 is located under the wave zone below the sea surface 104, the displacement of the buoyancy element 50 is small and can therefore effectively be ignored for the purpose of this description. The flexible tubular jumper members 80 permit the vessel 100 to move without disrupting the flow of hydrocarbons. To demonstrate the minimum clearance with the buoyancy element 50 in the harshest environmental conditions, two hydrocarbon production turret positions marked A and B in the possible extreme hydrocarbon production turret 20 position circular envelope are shown.

A decrease of the hydrocarbon production turret 20 offset distance R can only be obtained with a stiffer mooring system 25. An increase in the distance of the buoyancy element 50 to the MEAN position of the hydrocarbon production turret 20, requires the use of longer flexible tubular jumper members 80. In any uniform layout of mooring lines 30 where the open sectors between the mooring lines is much smaller than shown, the mooring lines 30 will severely interfere with the tethers 62 which hold the buoyancy element 50 in place.

In the preferred embodiment, three groups 31, 32, 33 of individual mooring lines 30 spaced 120° around the hydrocarbon production turret 20 are shown.

Figure 4A:
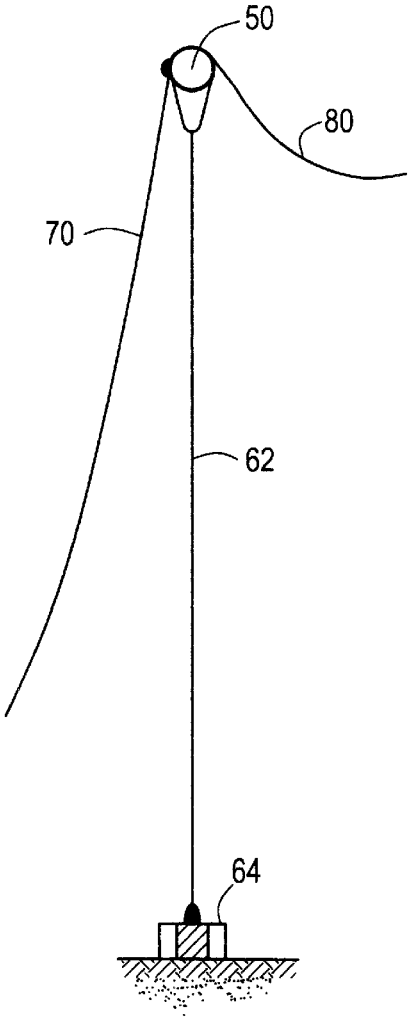
FIG. 4A is a side elevational view of the mounting system for the subsea buoyancy element taken at Line A—A of FIG. 4B.
Figure 4B:
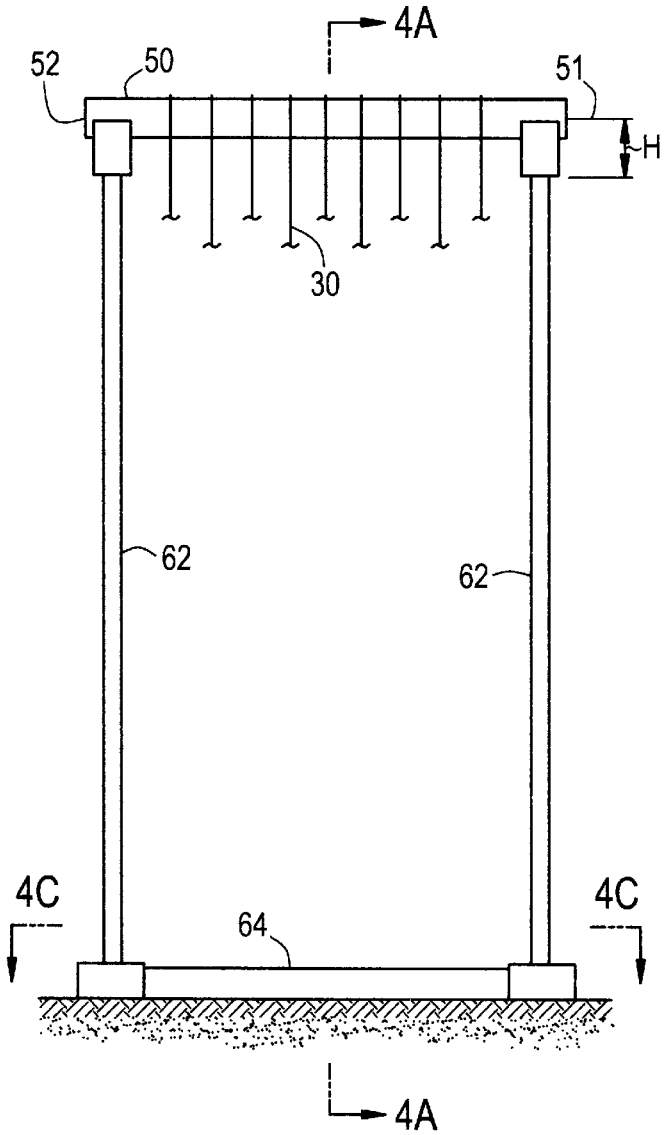
FIG. 4B is a front elevational view of the mounting system for the subsea buoyancy element.
Figure 4C:
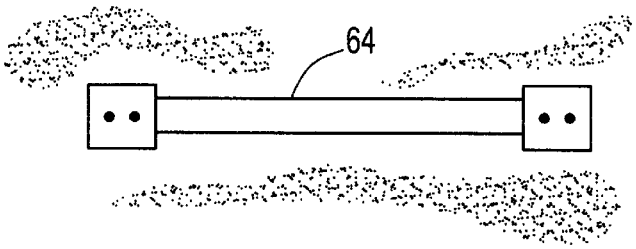
FIG. 4C is a top plan view of a gravity base used in the mounting system for the subsea buoyancy element.
Figure 5:
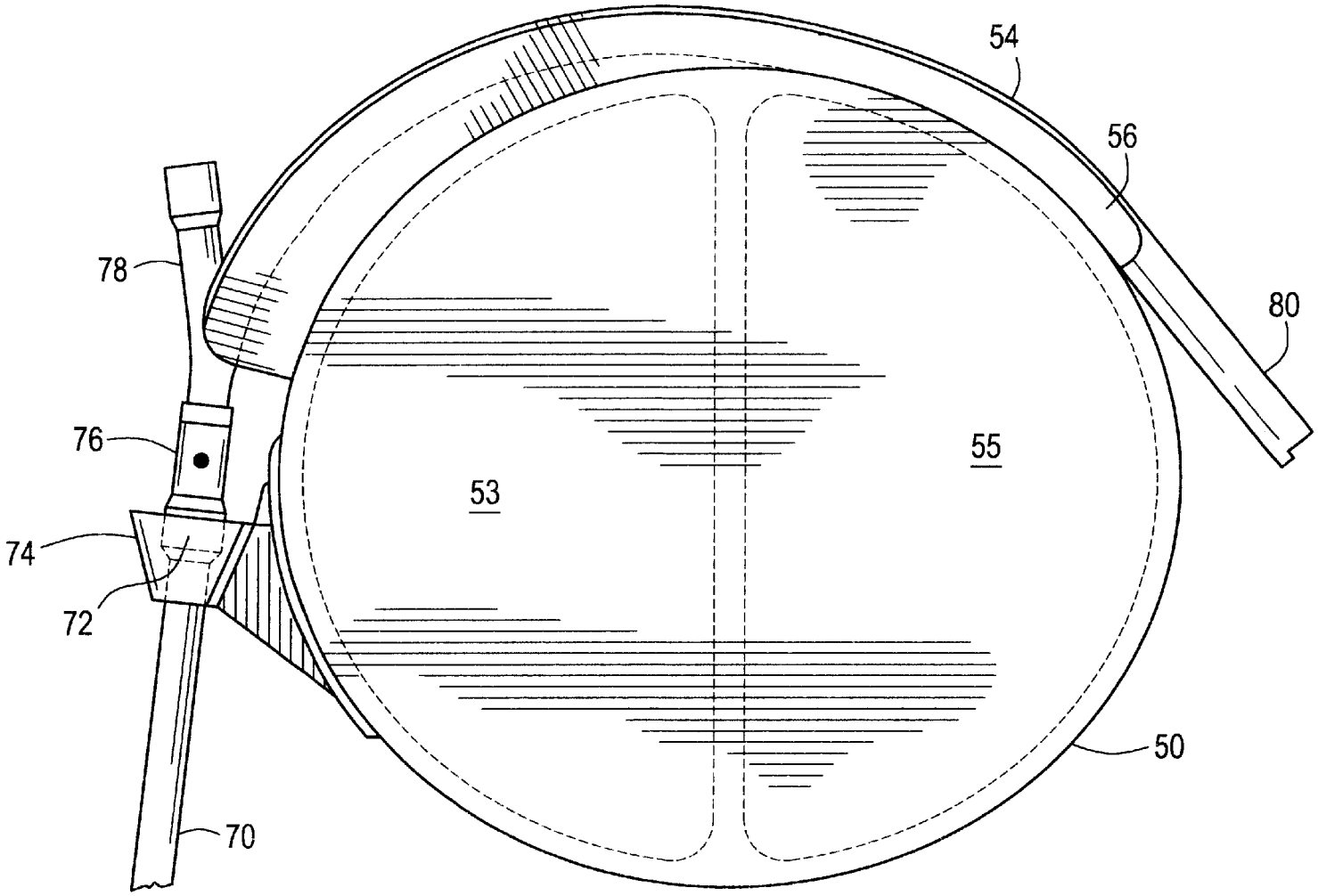
FIG. 5 is a side elevational view of the subsea buoyancy element.

FIGS. 4A, 4B and 4C show the system 60 for holding the buoyancy element 50 in place. In the preferred embodiment the horizontal, long and slender circular buoyancy element 50 is affixed to a gravity base structure 64 on the sea floor 102 by tethers 62 located at each end 52 of the buoyancy element 50. Production risers 70 are suspended from one side of the buoyancy element 50 and then proceed on to the sea floor 102. As shown in FIG. 5, the flexible tubular jumper members 80 are connected to the production risers 70 and are laid in a gutter 54 formed on the top of the buoyancy element 50. The flexible tubular jumper members 80 are suspended by the buoyancy element 50 before proceeding on to the hydrocarbon production turret 20 associated with the floating body or vessel 100. The buoyancy element 50 provides sufficient buoyancy to counteract the weight of the buoyancy element 50 itself, the weight of the production risers 70, the weight of the flexible connectors 80 and the tension forces of the tethers 62 on the riser buoyancy element 50. If desired, the buoyancy element 50 may be divided into multiple sections or chambers 53, 55. These chambers 53, 55 may be sized to have sufficient buoyancy to support the steel catenary production risers 70 and the flexible tubular jumper members 80. The buoyancy element 50 may be made of metal, concrete, foam, synthetic materials or any combination thereof. While a cylindrical subsea buoyancy element 50 is shown, it will be understood by those of ordinary skill in the art that other shapes may be used without departing from the scope of the invention.

The gravity base structure 64, when entirely ballasted with sea water, provides sufficient gravity force to counteract the upward tension forces of the tethers 62 in all possible operational conditions and environmental loading, as well as selected damage conditions during the life of the riser system 27. Each of the two tethers 62 may be made from two or more chains, steel wire ropes or synthetic fiber ropes or a combination thereof.

As shown in FIG. 4B, each tether 62 may be connected to the buoyancy element 50 at a distance H from the center line 51 of the buoyancy element 50 to avoid excess rotation of the buoyancy element 50 about its longitudinal axis 51 due to the forces of the steel catenary production riser 70 and the flexible tubular jumper members 80 on the riser buoyancy element 50.

FIG. 5 shows the production risers 70 and flexible tubular members 80 connected to the buoyancy element 50. The production risers 70 coming from the sea bed 102 are suspended in a receptacle 72. Between the top of each production riser 70 and the receptacle 72, a flex element 74 is connected. This flex element 74 absorbs relative rotations between the buoyancy element 50 and the production riser 70 without introducing excessive bending moments in the top of the production riser 70. A flexible tubular jumper member 80 is connected to each production riser 70 with a connector 76. The flexible tubular jumper member 80 is laid over the riser buoyancy element 50 in a gutter 54. Optionally, a Y fitting 78 can be located between the connector 76 and the flexible jumper member 80 to allow pigging of the riser pipe 70.

Figure 6A:
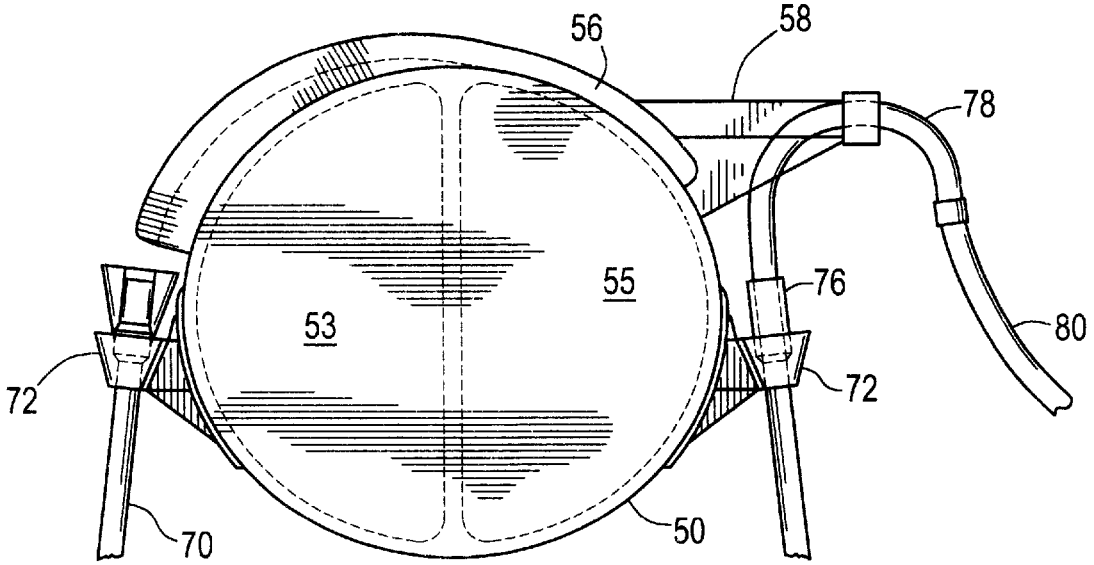
FIG. 6A is a side elevational view of an alternate embodiment of the subsea buoyancy element.
Figure 6B:
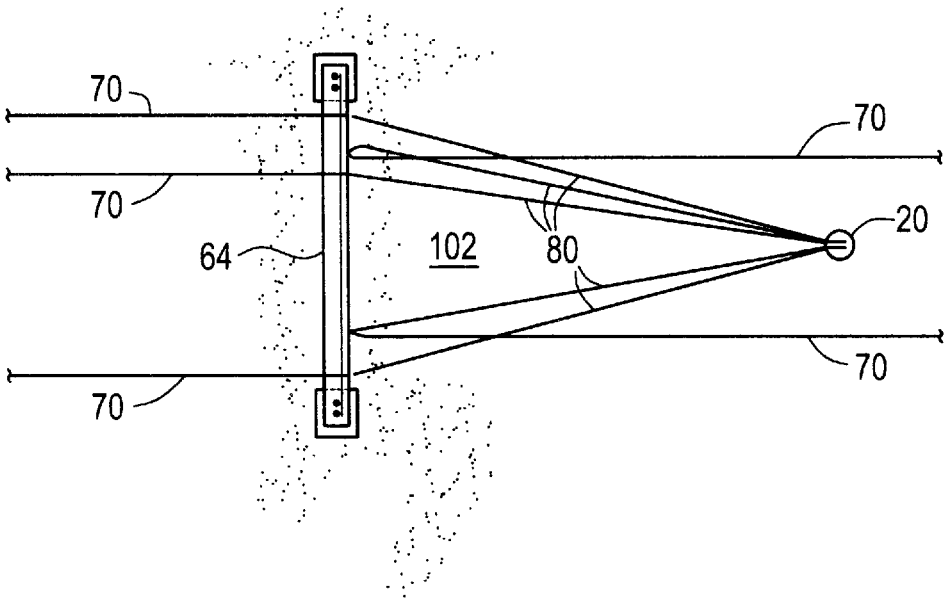
FIG. 6B is an overhead schematic view of the arrangement of production risers associated with the alternate embodiment of the invention shown in FIG. 6A.

As shown in FIGS. 6A and 6B, in an alternate embodiment, a production riser 70 can be suspended from either side of the buoyancy element 50. This arrangement minimizes the lengths of the production risers 70 on the sea floor 102. The flexible jumper members 80 are always located on one side of the buoyancy element 50. In case both the production risers 70 and the flexible jumper members 80 are located on the same side of the buoyancy element 50, the connection between the production risers 70 and the flexible jumper members 80 is the same as described in FIG. 5, with an additional hard pipe connection 78 between the connector 76 and the flexible jumper member 80. To support the flexible jumper member 80 in the alternate embodiment, an arm support 58 may be attached to the buoyancy element 50.

By use of the system of the present invention, it is now possible to install the groups of mooring lines and the riser system during those periods of time when the weather is favorable, and then connect, disconnect or re-connect the hydrocarbon production vessel to the groups of mooring lines and the riser system at any time during the year. Following the initial installation of the groups of mooring lines and the riser system, it is possible to add or remove steel catenary risers if one or more risers require repair or modification. Similarly, one or more risers may be added or removed to facilitate the phased development of hydrocarbon reserves and one or more subsea buoyancy elements may be added or removed to facilitate the phased development of hydrocarbon reserves.

While the present invention has been described by reference to both its preferred and alternate embodiments, it will be understood by those of ordinary skill in the art that numerous other embodiments of the instant invention are possible. Such numerous other embodiments shall fall within the scope and meaning of the appended claims.

What is claimed is:

1. A system for transporting hydrocarbons from reserves located under the sea floor to a hydrocarbon production turret located in a hydrocarbon production vessel rotatably connected to said hydrocarbon production turret at the sea surface through at least one substantially rigid catenary riser extending from the sea floor, said system for transporting hydrocarbons comprising:

three groups of mooring lines spaced approximately 120° apart, each group of mooring lines containing three individual mooring lines;

said three groups of mooring lines having open sectors therebetween and each of said three individual mooring lines being attached to the sea floor on a first end and attached to the hydrocarbon production turret on a second end;

a system to support the at least one substantially rigid catenary riser located in at least one of said open sectors, said system to support the at least one substantially rigid catenary riser including:

a subsea buoyancy element;

means for affixing said subsea buoyancy element to the sea floor so that said subsea buoyancy element floats beneath the sea surface;

the at least one substantially rigid catenary riser extending to said subsea buoyancy element;

at least one flexible tubular jumper member extending from said subsea buoyancy element to the hydrocarbon production turret;

means for interconnecting said at least one substantially rigid catenary riser to said at least one flexible tubular jumper member;

said means for interconnecting said at least one substantially rigid catenary riser to said at least one flexible tubular jumper member being located at said subsea buoyancy element.

2. The system as defined in claim 1 wherein said subsea buoyancy element is substantially longitudinal about a longitudinal axis.

3. The system as defined in claim 2 wherein said longitudinal axis is substantially parallel to the sea floor.

4. The system as defined in claim 1 wherein said subsea buoyancy element includes concrete, foam or other synthetic material.

5. The system as defined in claim 1 wherein said subsea buoyancy element includes metal, foam or other synthetic material.

6. The system as defined in claim 1 wherein said means for affixing said subsea buoyancy element to the sea floor includes a gravity base.

7. The system as defined in claim 1 wherein said means for affixing said subsea buoyancy element to the sea floor includes a piled base.

8. The system as defined in claim 1 wherein said means for affixing said subsea buoyancy element to the sea floor includes at least one tether.

9. The system as defined in claim 1 wherein said subsea buoyancy element includes a plurality of buoyancy sections, each of said buoyancy sections being capable of maintaining the buoyancy of said subsea buoyancy element.

10. A system for transporting hydrocarbons from reserves located under the sea floor through a subsea wellhead on the sea floor, thence through at least one substantially rigid catenary riser to the sea surface, said system for transporting hydrocarbons comprising:

a vessel rotatably connected to a hydrocarbon production turret for receiving hydrocarbons from the subsea wellhead;

three groups of mooring lines spaced approximately 120° apart, each group of mooring lines containing three individual mooring lines;

said three groups of mooring lines having open sectors therebetween and each of said three individual mooring lines being attached to the sea floor on a first end and attached to said turret on a second end;

a system to support the at least one substantially rigid catenary riser located in at least one of said open sectors, said system to support the at least one substantially rigid catenary riser including:

a subsea buoyancy element;

means for affixing said subsea buoyancy element to the sea floor so that it floats beneath the sea surface;

at least one substantially rigid catenary riser extending from said at least one subsea wellhead to said subsea buoyancy element;

at least one flexible tubular jumper member extending from said subsea buoyancy element to said hydrocarbon production turret;

means for interconnecting said at least one substantially rigid catenary riser to said at least one flexible tubular jumper member;

said means for interconnecting said at least one substantially rigid catenary riser to said at least one flexible tubular jumper member being located near said subsea buoyancy element.

11. The system as defined in claim 10 wherein said vessel can be connected, disconnected or re-connected to said at least three groups of mooring lines and said riser system after said at least three groups of mooring lines and said riser system have been installed.

12. The system as defined in claim 10 wherein individual ones of said at least one substantially rigid catenary riser can be added or removed without disturbing said production vessel whenever repair or modification of said risers is required.

13. The system as defined in claim 10 wherein individual ones of said at least one substantially rigid catenary riser can be added or removed without disturbing said production vessel to enable the phased development of reserves of hydrocarbons.

14. The system as defined in claim 10 wherein individual ones of said at least one substantially rigid catenary riser can be added or removed without disturbing said production vessel whereby the installation of at least one additional subsea buoyancy element is enabled.

15. The system as defined in claim 10 wherein said subsea buoyancy element is substantially longitudinal about a longitudinal axis.

16. The system as defined in claim 15 wherein said longitudinal axis is substantially parallel to the sea floor.

17. The system as defined in claim 10 wherein said subsea buoyancy element includes concrete, foam or other synthetic material.

18. The system as defined in claim 10 wherein said subsea buoyancy element includes metal, foam or other synthetic material.

19. The system as defined in claim 10 wherein said means for affixing said subsea buoyancy element to the sea floor includes a gravity base.

20. The system as defined in claim 10 wherein said means for affixing said subsea buoyancy element to the sea floor includes a piled base.

21. The system as defined in claim 10 wherein said means for affixing said subsea buoyancy element to the sea floor includes at least one tether.

22. The system as defined in claim 10 wherein said subsea buoyancy element includes a plurality of buoyancy sections, each of said buoyancy sections being capable of maintaining the buoyancy of said subsea buoyancy element.

23. A method for transporting hydrocarbons from at least one well located on the sea floor over a reserve of hydrocarbons through at least one substantially rigid catenary production riser to a hydrocarbon production turret rotatable connected to a vessel on the sea surface, said method comprising the steps of:

securing the hydrocarbon production turret in a position on the sea surface with three groups of mooring lines spaced approximately 120 degrees apart, said three groups of mooring lines each having three individual mooring lines and open sectors between said three groups of mooring lines;

affixing a subsea buoyancy element to the sea floor so that said subsea buoyancy element floats beneath the sea surface within one of said open sectors;

conducting the at least one substantially rigid catenary production riser from the at least one well on the sea floor to the subsea buoyancy element;

conducting a plurality of flexible tubular jumper members from said subsea buoyancy element to the hydrocarbon production turret;

connecting said at least one substantially rigid catenary production riser to said at least one flexible tubular jumper member.

24. The method as defined in claim 23 wherein said hydrocarbon production turret is placed in a vessel.

* * * * *